US005855493A

United States Patent [19]

Shelly

[11] Patent Number: 5,855,493

[45] Date of Patent: Jan. 5, 1999

[54] ELECTRICAL CONNECTOR STRAIN RELIEF WITH SHIELD GROUND FOR MULTIPLE CABLES

[75] Inventor: Christopher Warren Shelly, Hummelstown, Pa.

[73] Assignee: The Whitaker Corporation, Wilmington, Del.

[21] Appl. No.: 954,538

[22] Filed: Oct. 20, 1997

Related U.S. Application Data

[63] Continuation of Ser. No. 613,833, Mar. 11, 1996, abandoned.

[51] Int. Cl.[6] ..... H01R 13/58

[52] U.S. Cl. ..... 439/465; 439/686; 439/579

[58] Field of Search ..... 431/465, 579, 431/460, 469, 686, 687, 701, 731

[56] References Cited

U.S. PATENT DOCUMENTS

| | | | |
|---|---|---|---|
| 3,138,658 | 6/1964 | Weimer, Jr. | 174/94 |
| 3,247,316 | 4/1966 | Weimer, Jr. | 174/94 |
| 3,977,755 | 8/1976 | Edel et al. | 439/610 |
| 4,272,148 | 6/1981 | Knack, Jr. | 439/610 |
| 4,615,578 | 10/1986 | Stadler et al. | 439/607 |
| 4,687,263 | 8/1987 | Cosmos, et al. | 439/108 |
| 4,822,286 | 4/1989 | Bianca | 439/610 |
| 4,830,628 | 5/1989 | Dyson et al. | 439/579 |
| 4,921,441 | 5/1990 | Sauder | 439/460 |
| 4,960,392 | 10/1990 | Dickie | 439/620 |
| 4,973,370 | 11/1990 | Kreinberg | 156/50 |
| 5,085,596 | 2/1992 | Bowen, et al. | 439/497 |
| 5,190,473 | 3/1993 | Mroczkowski, et al. | 439/580 |
| 5,348,494 | 9/1994 | Falossi et al. | 439/465 |
| 5,505,637 | 4/1996 | Krämer, et al. | 439/610 |

FOREIGN PATENT DOCUMENTS

| | | | |
|---|---|---|---|
| 069 191 A1 | 4/1995 | European Pat. Off. | H01R 13/658 |
| 2 060 275 A | 4/1981 | United Kingdom | H01R 13/648 |
| 2 199 198 A | 6/1988 | United Kingdom | H01R 4/00 |

*Primary Examiner*—Steven L. Stephan
*Assistant Examiner*—T. C. Patel
*Attorney, Agent, or Firm*—Anton P. Ness; Mary K. VanAtten

[57] ABSTRACT

A cable connector (20) for terminating a plurality of cables (26) in a clamping manner and matable with a complementary connector (10). Cable connector (20) includes a housing (32) and a backshell subassembly (62) having a pair of covers (66,68) and a pair of inserts (70,72) and can include a ground assembly (120) for gang termination of ferrule-terminated braid portions of shielded signal cables. Ground assembly (120) includes a commoning strip (122) compressed between ferrules (58) of the two rows of cables (26), and further includes a conductor (124) extending to a ground terminal (128) in housing (32).

16 Claims, 6 Drawing Sheets

ELECTRICAL CONNECTOR STRAIN RELIEF WITH SHIELD GROUND FOR MULTIPLE CABLES

This application is a Continuation of application Ser. No. 08/613,833 filed Mar. 11, 1996, now abandoned.

FIELD OF THE INVENTION

The present invention relates to the field of electrical connectors and more particularly to cable strain relief thereof.

BACKGROUND OF THE INVENTION

Electrical connectors are known for termination to a plurality of electrical cables and matable to complementary connectors at an input/output port of an electronic apparatus such as test equipment. Each such cable connector must provide a strain relief so that strain applied to the connector by the cables reacts to the connector housing to protect the terminations of terminals to the conductors of the cables, and various clamping mechanisms have been utilized in electrical connectors by strain relief sections of the connector housing generally compressing the insulative jackets of the cables at the connector's cable exit.

In arrangements where shielded signal lines are to be connected to the electronics of an apparatus, it has been conventional to utilize coaxial cables and to provide separate connections by way of respective single-cable electrical connectors mounted at separate panel cutouts of the apparatus. It is desired to provide a single connector for a plurality of such shielded signal lines.

It is desired to provide a strain relief for such a connector that establishes a ground connection of a ground terminal at the connector mating interface, with the shielding braids of a plurality of cables, when shielded cables are utilized to provide protected signal paths.

It is further desired to provide such a strain relief in a connector that is capable of being disassembled to permit removal and replacement of one or more such shielded cables, and then reassembled.

SUMMARY OF THE INVENTION

The connector of the present invention utilizes a backshell subassembly securable to the rearward end of a dielectric connector housing, with the subassembly formed by pair of opposing covers and a pair of opposing inserts securable therebetween about the cables rearwardly from the terminated ends thereof, for cables that may be noncoaxial or coaxial. The backshell covers together define a housing-receiving cavity at their forward ends and include sections for becoming fixed to the housing rearward end, after which the covers are fastenable together such as by self-tapping screws. Preferably, at least one cover is adapted to be affixed to the housing without discrete fasteners, thus holding the housing fixed in position during assembly of the cables into the connector.

For shielded signal lines, the cables are of the coaxial type having a ground shield about an insulated inner signal conductor to which a terminal is affixed at its end; the cables are prepared by stripping the end portion of the outer jacket to expose a length of the ground shield rearwardly from the terminated signal conductor end; a conductive band or ferrule is preferably secured around the exposed ground shield portion of each cable; and the backshell subassembly provides for gang termination of the cable ground shields. A ground assembly is securable within the covers in cooperation with the inserts, and includes a conductor length extending to a ground terminal to be secured in a selected position within the housing, and further includes a commoning strip routed transversely across the cable paths at the conductive ferrules. When the backshell subassembly is assembled to the cable ends in manner compressing the outer jackets of all the cables sufficiently to define the strain relief, the commoning strip is clamped between the conductive ferrules in such a manner as to assuredly engage each one thereof preferably under compression, thereby grounding the shields of the cable to the ground terminal.

It is an objective of the present invention to provide a cable strain relief for a multi-cable electrical connector that is capable of being disassembled to permit removal and replacement of one or more of the cables and then being reassembled.

It is a further objective to provide such a strain relief having a low profile, or minimized overall cross-sectional dimensions.

It is yet another objective to provide such a strain relief with a grounding means that defines a ground connection with ground shields of all the cables upon assembly and defining a ground circuit to a ground terminal at the connector's mating interface, and is consistent with the capability of the connector to be disassembled and reassembled.

It is still another objective to provide a kit of parts enabling the electrical connection of a plurality of shielded signal lines to an apparatus at a single cutout thereof for high voltage low current signal transmission, while providing gang termination of the cable shielding braids and cable strain relief, all in a manner permitting disassembly and reassembly for repair and servicing.

An embodiment of the present invention will now be described by way of example with reference to the accompanying drawings.

DETAILED DESCRIPTION OF THE PREFERRED EMBODIMENT

Figure 1:
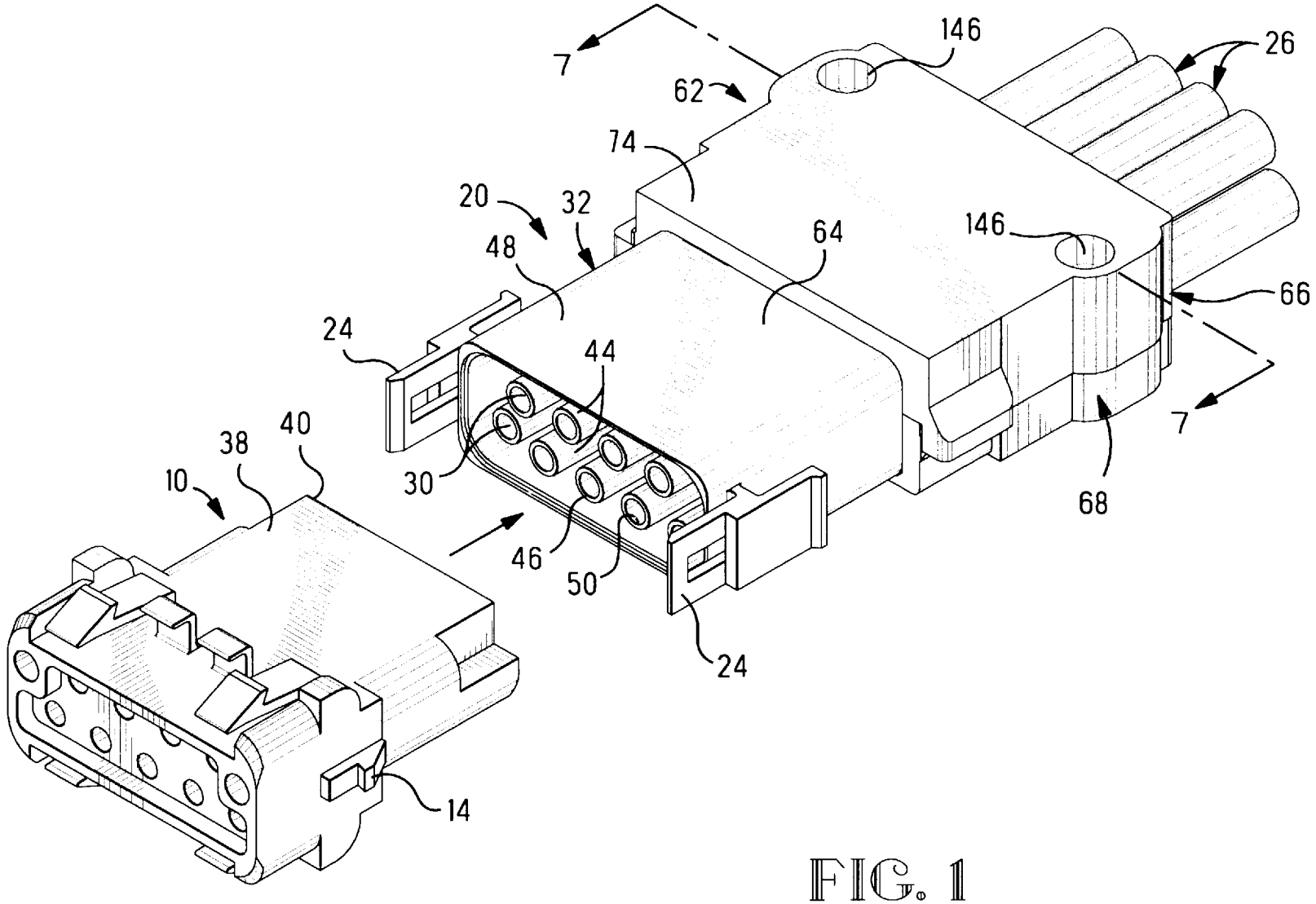
FIG. 1 is an isometric view of a pair of connectors matable at a mating interface, with one thereof terminating a plurality of cables.
Figure 2:
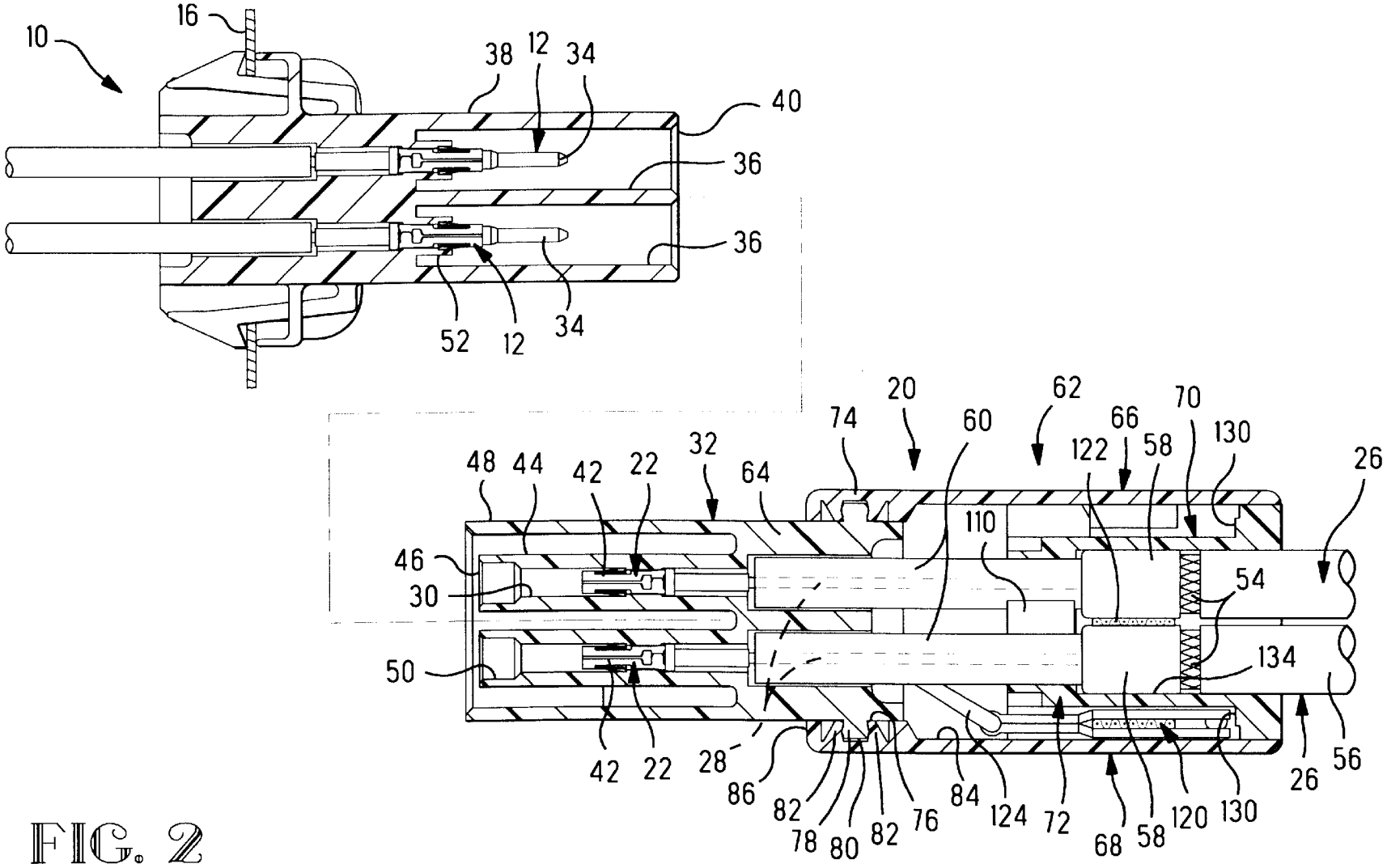
FIG. 2 is a longitudinal section view of the matable connectors of FIG. 1.
Figure 3:
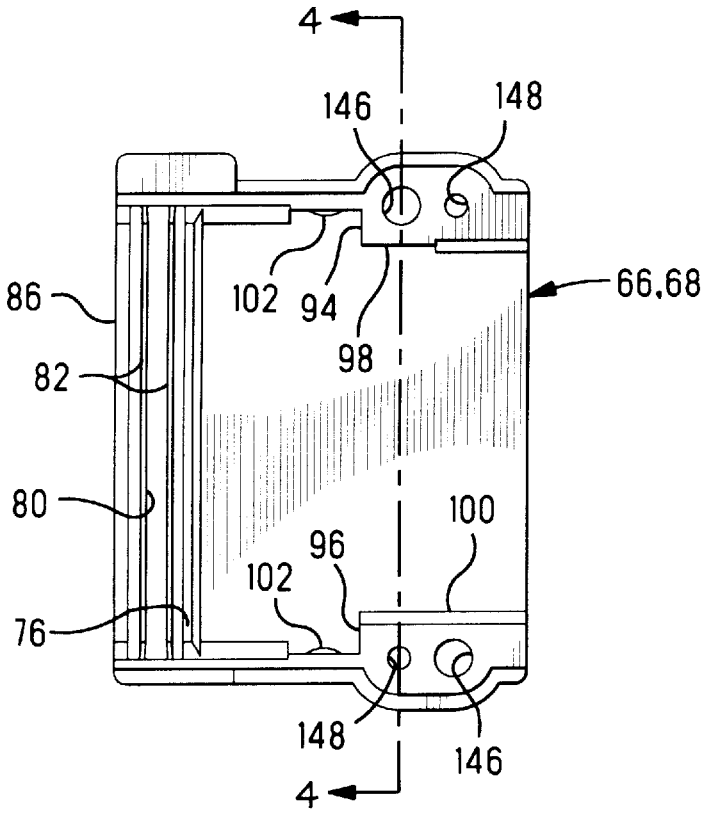
FIGS. 3 and 4 are inside plan and cross-sectional views of a backshell of the cable connector of FIGS. 1 and 2.
Figure 4:
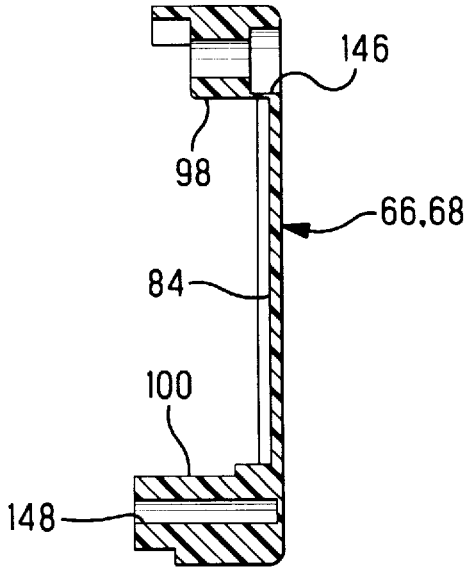
Figure 5:
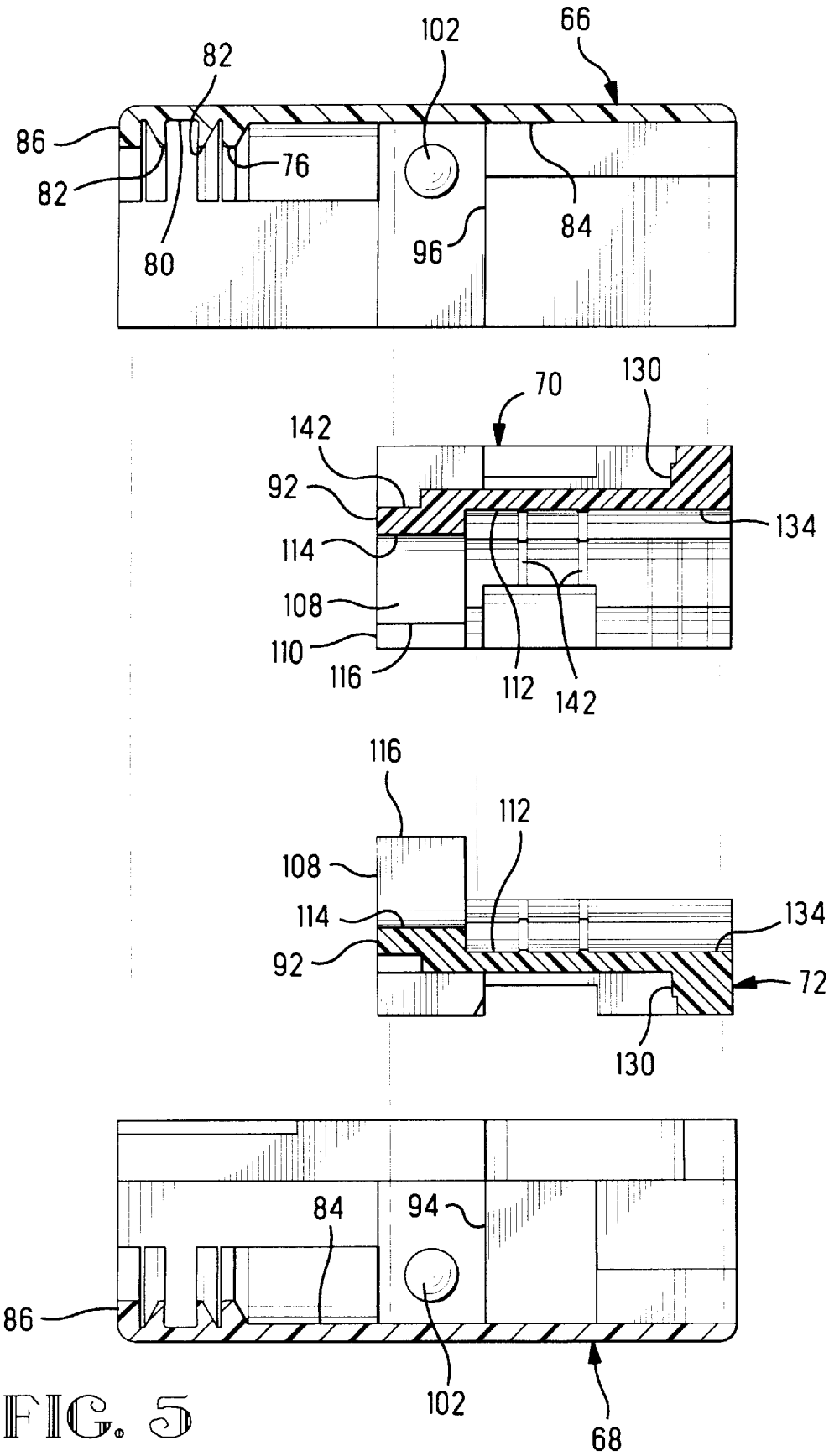
FIG. 5 is an exploded longitudinal section view of the backshell covers and inserts of the cable connector.

FIGS. 1 and 2 show a panel-mountable connector 10 having a plurality of electrical terminals 12 and a cable connector 20 having a plurality of electrical terminals 22, the connectors being matable at a mating interface and latchable together by latches 14,24. Connector 10 is of dielectric material and is shown mounted in a cutout of a panel 16 of an electrical apparatus with opposing arrays of panel engaging latches. Cable connector 20 is secured to end portions of a plurality of electrical cables 26, whose signal conductors 28 are terminated to terminals 22 disposed within respective passageways 30 of a dielectric housing 32.

Terminals 12 are shown as having pin contact sections 34 disposed within discrete large passageway portions 36 of plug portion 38 of connector 10 and recessed from the connector leading end 40, and terminals 22 are shown as having socket contact sections 42 disposed within discrete silos 44 and recessed from leading ends 46 thereof in the receptacle portion 48 of housing 32, an arrangement that provides dielectric material about each mated terminal pair establishing significant protection against voltage leakage or corona when high voltage low current signals are transmitted through the circuits of the mated connectors during in-service use. Further, an enlarged silo entrance 50 receives a flange section 52 about the base of each pin contact section 34 of a terminal 12 for improved voltage leakage protection by lengthening the path necessary for any voltage leakage to occur.

Cables 26 as shown are coaxial cables having ground shield braids 54 around the insulated signal conductor 28, with an outer jacket 56 therearound. The cables are prepared by stripping the end portion of the outer jacket 56 to expose a length of the braid 54, after which a ferrule 58 is crimped thereto, with ferrule 58 being for example a TERMASHIELD ferrule sold by AMP Incorporated, Harrisburg, Pa., USA, the ferrule providing an inner support surface underlying the braid to facilitate crimping. Preferably the crimping of ferrule 58 is performed utilizing a crimping tool in which the crimping surfaces are cylindrical to minimize any out-of-round deformation of the ferrule. An insulated portion 60 of the signal conductor 28 is seen extending forwardly beyond the ferrule-terminated braid.

Referring to FIGS. 2 to 6, backshell subassembly 62 is secured to dielectric housing 32 at rearward housing end 64, and includes a pair of opposed covers 66,68 containing a pair of opposed inserts 70,72 of preferably resilient dielectric material that together surround portions of cables 26 rearwardly from terminals 22 in housing 32. The subassembly 62 is securable to the housing 32 such as by providing a forward subassembly end 74 creating a housing-receiving cavity 76 forwardly of inserts 70,72 for receipt thereinto of rearward housing end 64. Covers 66,68 are shown to be affixed to rearward housing end 64 by means of a preferably undercut rib 78 of the housing rearward end being received in a snap or interference fit in slot 80 between a pair of ribs 82 along inside surfaces 84 of covers 66,68 and spaced inwardly from the forward ends 86 of the covers.

Each insert 70,72 is preferably securable within a respective cover 66,68 without fasteners, such as by a latching arrangement as shown or optionally by an interference fit. Insert mounting flanges 88,90 at forward insert end 92 are received into corresponding slots 94,96 in side walls 98,100 of covers 66,68; convex embossments 102 are defined in slots 94,96 and become seated in corresponding concavities 104 along side surfaces of mounting flanges 88,90 thus latching the insert in an associated cover. The latching arrangement defined by dome-shaped convex embossments 102 facilitates later removal of the insert from the cover should it be desired, such as for access to the ground assembly. The covers are preferably secured to each other about the cables and inserts and rearward housing end 64 by use of bolts or screws; especially self-tapping screws 106 (FIG. 7), such that they may be later disassembled, if desired.

Each insert includes projections 108,110 coextending from the cable-proximate face 112 at forward insert end 92, with the projections simultaneously defining cable-receiving grooves 114 therebetween and also defining concave cable-engaging surfaces 116 at free ends thereof. The inserts are utilized such that the projections and grooves are staggered, that is, that the projections of each are opposed from the grooves of the other. Upon assembly around the cables, each cable 26 is disposed in a respective groove 114 of one insert 70 or 72 and is engaged by the cable-engaging surface 116 of a projection 108,110 of the other insert 72 or 70. Preferably the inserts are identical with the array of grooves and projections being offcentered, so that the inserts thus may be hermaphroditic.

Figure 6:
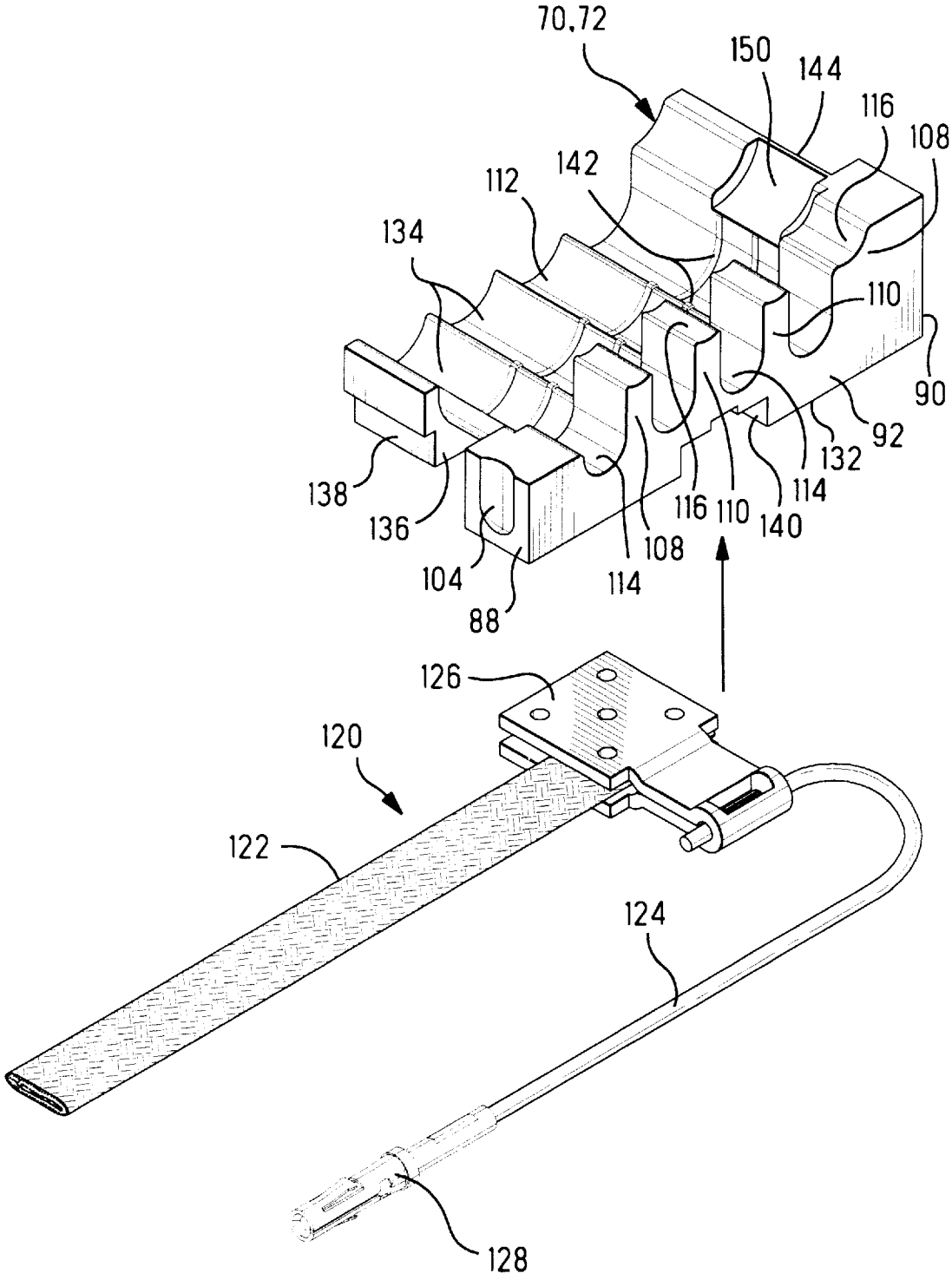
FIG. 6 is an isometric view of an insert of FIGS. 2 and 5, and exploded therefrom the ground assembly of the present invention.

Referring to FIG. 6, ground assembly 120 includes a commoning strip 122 and a length of conductor wire 124 electrically interconnected such as by a TERMIFOIL interconnecting terminal 126 sold by AMP Incorporated, with a ground terminal 128 terminated to a forward end of conductor wire 124 and preferably identical to terminals 22 and housed in housing 32 in an identical manner. Commoning strip 122 is preferably a resilient conductor such as a length of braid of the type commonly used in the fabrication of shielded cable, and having a width about equal to the axial length of a TERMASHIELD ferrule 38 crimped around the braids 54 of cables 26 (FIG. 2).

Figure 7:
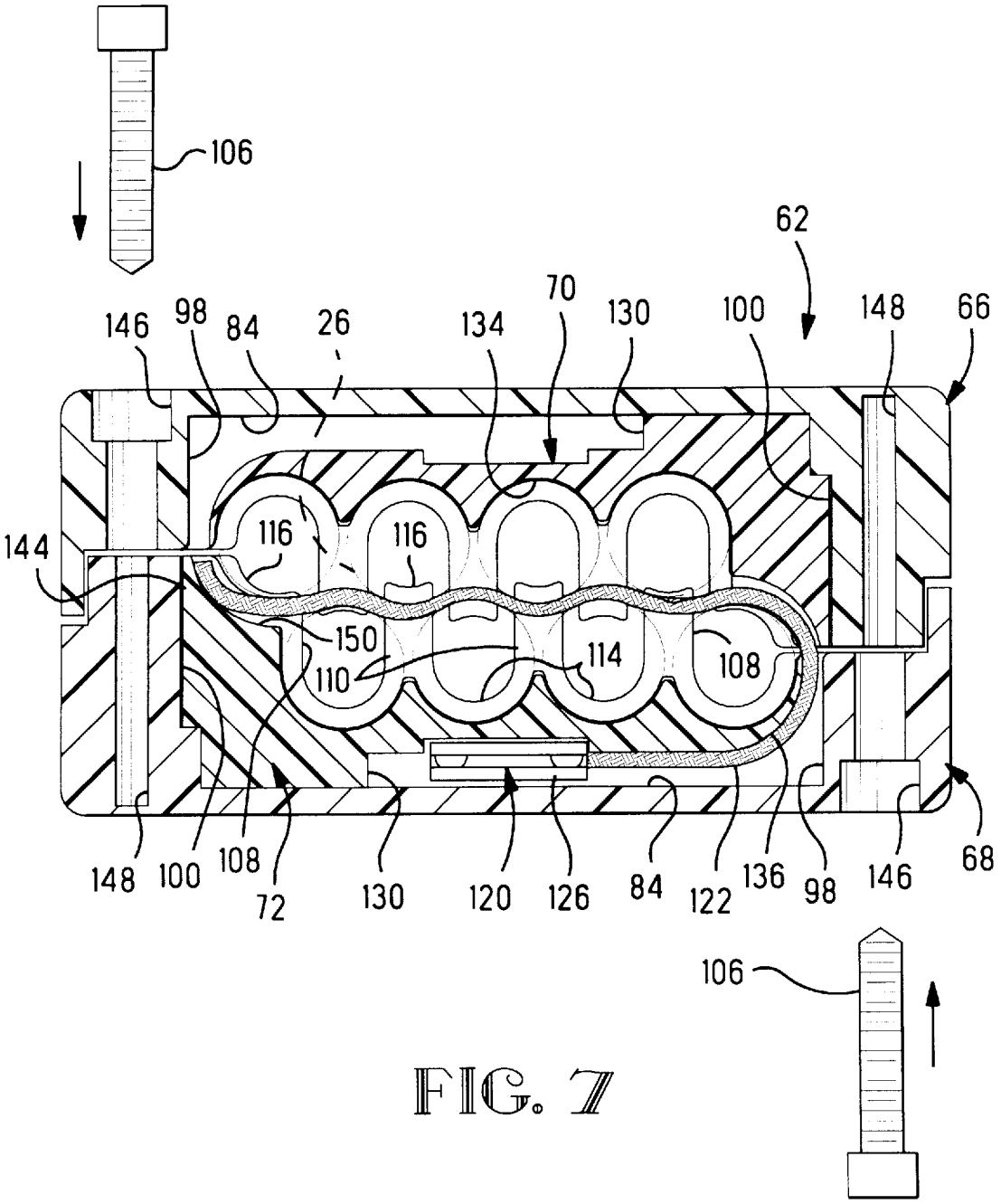
FIG. 7 is a cross-sectional view of the cable connector taken along lines 7—7 of FIG. 1.

Referring now primarily to FIG. 7, ground assembly 120 may be assembled into cable connector 20 such as by terminal 126 being disposed in an interference fit into a pocket 130 along an outwardly facing surface 132 of an insert 72, with pocket 130 being positioned axially to coincide with the forward portion of enlarged inner and outer groove portions 134,135 just rearwardly of projections 108,110. Commoning strip 122 is routed from pocket 130 along a preferably arcuate recess 136 of a side wall 138 of the insert, after which insert 72 and ground assembly 120 are placed into position along inner surface 84 of lower cover 68, with commoning strip 122 extending along side wall 98 of cover 68. A portion of interconnecting terminal 126 affixed to an end of conductor wire 124 extends through channel 140 of insert 72 and forwardly of forward insert end 92, and conductor wire 124 with ground terminal 128 is routed in a forward direction along side wall 100. Housing 32 is then placed into position forwardly of insert 72 by undercut rib 78 along the lower surface of housing 32 and adjacent side wall portions, being urged laterally into slot 80 between ribs 82 of cover 68 to be held in a snug fit therein along inner surface 84 and side walls 98,100 of the cover, after which ground terminal 128 on conductor wire 124 is inserted into the associated passageway of housing 32 at the end of the row of passageways near cover side wall 100. The fixed relationship of housing 32 and cover 68 enables its position and orientation to be held stable during cable placement, greatly facilitating the assembly of the cable connector.

Prepared ends of cables 26 are then disposed into grooves 114 of the insert 72 to define one of the rows of cables, with terminals 22 inserted into passageways 30 of housing 32 and with ferrule-terminated braid portions positioned within the forward portions of enlarged groove portions 134,135 to coincide with the axial position of commoning strip 122. It is preferred that low height radial flanges 142 be provided along the bottom surfaces of enlarged groove portions 134,135 to accommodate the slightly outwardly extending creases of each ferrule 58 resulting from crimping to the braid, irrespective of their angular location about the cable. Commoning strip 122 is then positioned atop the ferrule-terminated braid portions to extend to the opposite side wall 144 of insert 72 for its end portion to rest in recess 150.

The other cables are then positioned above the first row of cables to define the second row, with insulated signal conductor portions disposed atop projections 108,110 of insert 72 and their ferrule-terminated braid portions adjacent commoning strip 122. The other insert 70 is then carefully placed into position over the second row of cables such that the cables thereof are appropriately routed along grooves 114, and projections 108,110 thereof abut insulated signal conductor portions of associated ones of the cables 26 of the first row. The other cover 66 is then placed into position with ribs 82 thereof snapping over undercut rib 78 along the upper surface and adjacent side wall portions of housing 32.

Fasteners 106 are then applied to covers 66,68 by insertion into countersunk holes 146 of respective covers 66,68 and into blind holes 148 of the opposing cover 68,66 aligned therewith. Covers 66,68 preferably are so shaped and dimensioned such that when fasteners 106 are fully applied, substantial clamping force is generated against the opposed inserts 70,72 to press the ferrule-terminated braid portions of cables 26 firmly against commoning strip 122 to create an assured grounding connection therebetween, and also to define a cable strain relief arrangement. It can be seen that commoning strip 122 becomes undulate from side to side conforming to the engaged surfaces of ferrules 58, making resilience of the commoning strip important to attain maximized engagement with the ferrule surfaces for assured grounding.

It is expected that inserts 70,72 will become bowed from side to side under the clamping force as the cables are compressed against the elongate commoning strip and each other. Either the covers themselves are so made to permit complementary bowing adjacent the inserts at the rearward end of the backshell subassembly, or central portions of the outer surfaces of the inserts are slightly spaced from adjacent portions of inner surfaces 84 of the covers enabling the covers to be made of rigid material such as die cast or impact extruded metal. Enlarged inner groove portions 134 are slightly elevated with respect to enlarged outer groove portions 135, compensating for anticipated bowing, all ultimately becoming coaligned upon bowing to hold the jacketed cable portions coaligned. Inner or central ones of projections 110 also accommodate such ultimate bowed insert shape by being slightly elevated with respect to outer projections 108 such that cable-engaging surfaces 116 at free ends thereof ultimately are coaligned upon bowing of inserts and in alignment with the cable-engaging surfaces 116 of central projections 110. The coaxial aligning of enlarged groove portions 134,135 and cable-engaging surfaces 116 with passageways 30 upon bowing of the inserts, together hold the cables and the insulated signal conductor portions of their associated cables in alignment with the two rows of passageways 30 of housing 32, and minimizing any tendency to skew the alignment of terminals 22 on the signal conductors. It is also preferable that fasteners 106 be self-tapping screws to permit sufficient insertion into their respective holes 146 and threading into blind holes 148 in covers 66,68 to create such clamping. However, other fastening means may be selected consistent with generation of the desired clamping together of backshell subassembly 62.

It can be seen that fasteners 106 are removable from backshell subassembly 62 enabling disassembly of cable connector 20 for repair and servicing, and reassembly thereafter. Alternatively, cable connector 20 may be filled with potting material to displace air and provide environmental sealing of the grounding connections between ground assembly 120 and the shielding braids of the cables, if desired. The particular panel-mounted and cable connectors of an associated pair may be provided with keying at the mating interface, if desired, to physically encode the mating connectors of the pair to prevent mating of one of the particular connectors with a connector of another pair.

Other variations and modifications may be made to the preferred embodiment described herein, without departing from the spirit of the invention and the scope of the claims.

What is claimed is:

1. An electrical connector for terminating a plurality of electrical cables, comprising:

a housing including a plurality of passageways for receipt thereinto of respective terminals terminated onto signal conductors of the cables; and a backshell subassembly including a pair of opposed covers securable about a rearward end of said housing and fastenable to each other to surround end portions of said cables extending rearwardly of said terminals in said housing passageways, with portions of said backshell subassembly adapted to clamp said cables upon said covers being fastened to each other;

said covers upon being fastened together defining a housing-receiving cavity at forward ends thereof between inner cover surfaces, with at least one said cover including a section at said forward end thereof adapted to cooperate with a complementary section of said housing rearward end to enable affixing said housing to said one cover in an interference fit without discrete fasteners to hold said housing fixed in position to said one cover thus facilitating assembly of said terminated cable ends into said connector, said complimentary section of said housing being an undercut rib.

2. The connector as set forth in claim 1 wherein said covers each include a pair of spaced-apart transverse ribs along said inner surface thereof spaced inwardly from said forward end thereof, and said housing rearward end includes a transverse rib along opposed outer surfaces associated with said inner cover surfaces and shaped and dimensioned to be assuredly held between said transverse ribs of said covers in a snug fit.

3. The cable connector as set forth in claim 2 wherein said at least one transverse rib of said housing and said one cover extend along side wall portions of both thereof adjacent said outer surfaces of said housing and adjacent said inner surface of said one cover respectively whereby said housing is fixable in position to said one cover during assembly.

4. The cable connector as set forth in claim 3 wherein both said transverse ribs of said housing and both said covers extend along side wall portions of both thereof adjacent said outer surfaces of said housing and adjacent said inner surfaces of said covers, respectively, whereby said housing is fixable in position to either one of said covers during assembly and said covers may be hermaphroditic.

5. An electrical connector for terminating a plurality of shielded electrical cables disposed in two rows, comprising:

a housing including a plurality of passageways for receipt thereinto of respective terminals terminated onto signal conductors of the cables; and a backshell subassembly including a pair of covers fastenable to each other and securable to a rearward end of said housing and around end portions of said cables rearwardly of said terminals in said housing passageways;

said backshell subassembly further including a pair of inserts securable between said covers along inner surfaces thereof rearwardly from said housing, with each said insert associated with a respective row of said cables and including grooves therealong for holding and positioning respective cables, and said inserts being adapted to clampingly engage said cables upon said covers being fastened to each other; and a ground assembly including an elongate conductive strip electrically connected to a ground terminal insertable into a said passageway of said housing, said elongate conductive strip extending transversely with respect to said backshell subassembly to be disposed between said two rows of shielded cables compressed against conductive ferrules crimped to shields of each said cable, thereby establishing a ground circuit between the shield of each said cable and said ground terminal.

6. The cable connector as set forth in claim 5 wherein said elongate commoning strip is resilient to conform to adjacent surfaces of said conductive ferrules upon full connector assembly.

7. The cable connector as set forth in claim 5 wherein each said cover including a pair of spaced-apart transverse ribs along said inner surface thereof spaced inwardly from said forward end thereof, and said housing rearward end including a transverse rib along opposed outer surfaces associated with said inner cover surfaces and shaped and dimensioned to be assuredly held between said transverse ribs of said covers in a snug fit.

8. The cable connector as set forth in claim 6 wherein said transverse ribs of said housing and said covers extend along side wall portions of both thereof adjacent said outer surfaces of said housing and adjacent said inner surfaces of said covers, respectively.

9. The cable connector as set forth in claim 5 wherein said ground assembly includes an elongate conductor extending to said ground terminal, and further includes a terminal interconnecting said elongate conductor and said elongate commoning strip.

10. The cable connector as set forth in claim 9 wherein a pocket is defined between a said insert and an associated said cover for containing said interconnecting terminal.

11. The cable connector as set forth in claim 10 wherein said insert includes said pocket, and said pocket is dimensioned and shaped to receive said interconnecting terminal in an interference fit.

12. The cable connector as set forth in claim 5 wherein forward portions of said grooves of each said insert are defined between projections extending toward the other said insert during connector assembly, with said grooves and projections of each said insert being laterally offset from those of the other said insert for each said projection of each said insert to be opposed from a said forward groove portion of the other said insert, and with each said projection concluding in a cable-engaging surface adapted to engage a portion of an insulated signal conductor portion of a said cable received into an opposed forward groove portion of the other said insert.

13. The cable connector as set forth in claim 12 wherein central ones of said projections of each said insert are slightly elevated with respect to other ones of said projections to initially extend farther toward the other said insert than said other projections.

14. The cable connector as set forth in claim 13 is resilient and at least slightly compressible.

15. The cable connector as set forth in claim 14 wherein said covers and said inserts are so shaped and dimensioned to permit bowing thereof centrally of their respective side walls upon full connector assembly about said cables to compress said elongate commoning strip against all said conductive ferrules terminated to said shields of said cables for assured grounding thereof.

16. An electrical connector for terminating a plurality of electrical cables, comprising:

a housing including a plurality of passageways for receipt thereinto of respective terminals terminated onto signal conductors of the cables; and a backshell subassembly including a pair of opposed covers securable about a rearward end of said housing and fastenable to each other to surround end portions of said cables extending rearwardly of said terminals in said housing passageways, with portions of said backshell subassembly adapted to clamp said cables upon said covers being fastened to each other;

said covers upon being fastened together defining a housing-receiving cavity at forward ends thereof between inner cover surfaces, with at least one said cover including a section at said forward end thereof adapted to cooperate with a complementary section of said housing rearward end to enable affixing said housing to said one cover, said section of said forward end of said cover engaging said complementary section of said housing securely, the engagement of said section at said forward end of said cover and said section of housing forms an interference fit and secures said cover to said housing.

* * * * *